US010487552B2

(12) United States Patent
Prison

(10) Patent No.: US 10,487,552 B2
(45) Date of Patent: Nov. 26, 2019

(54) MOTOR VEHICLE HINGE

(71) Applicant: Edscha Engineering GmbH, Remscheid (DE)

(72) Inventor: Stefan Prison, Leverkusen (DE)

(73) Assignee: EDSCHA ENGINEERING GMBH, Remscheid (DE)

( * ) Notice: Subject to any disclaimer, the term of this patent is extended or adjusted under 35 U.S.C. 154(b) by 397 days.

(21) Appl. No.: 15/022,875

(22) PCT Filed: Sep. 18, 2014

(86) PCT No.: PCT/DE2014/000470

§ 371 (c)(1),
(2) Date: Mar. 17, 2016

(87) PCT Pub. No.: WO2015/039644

PCT Pub. Date: Mar. 26, 2015

(65) Prior Publication Data

US 2016/0208534 A1 Jul. 21, 2016

(30) Foreign Application Priority Data

Sep. 19, 2013 (DE) ..... 20 2013 008 268

(51) Int. Cl.
*E05D 11/10* (2006.01)
*E05D 5/02* (2006.01)
*E05D 3/02* (2006.01)

(52) U.S. Cl.
CPC ..... *E05D 11/1071* (2013.01); *E05D 3/02* (2013.01); *E05D 5/0207* (2013.01);
(Continued)

(58) Field of Classification Search
CPC ... E05D 11/1071; E05D 11/1057; E05D 3/02; E05D 5/0207; E05D 2011/1035;
(Continued)

(56) References Cited

U.S. PATENT DOCUMENTS 5,918,347 A 7/1999 Morawetz
6,581,243 B2 * 6/2003 Parizel ..... E05D 11/1071 16/334

(Continued)

FOREIGN PATENT DOCUMENTS

CN 101031699 A 9/2007
CN 203201338 U 9/2013

(Continued)

OTHER PUBLICATIONS

Written Opinion for corresponding PCT International Application.
Search Report for corresponding PCT International Application.

*Primary Examiner* — William L Miller
(74) *Attorney, Agent, or Firm* — Davidson, Davidson & Kappel, LLC

(57) ABSTRACT

A motor vehicle hinge is provided. The motor vehicle hinge includes a first hinge half which can be fastened to one of motor vehicle door and door frame, and a second hinge half which can be fastened to the other of motor vehicle door and door frame, and a hinge pin which connects the two hinge halves in an articulated manner. At least one of the two hinge halves has a supporting structure and an insert and the supporting structure and the insert are fixed with respect to one another. The hinge pin is mounted on at least one eye of the supporting structure.

25 Claims, 3 Drawing Sheets

(52) U.S. Cl.
CPC . *E05D 2011/1035* (2013.01); *E05Y 2600/626* (2013.01); *E05Y 2900/531* (2013.01); *Y10T 16/54028* (2015.01)

(58) Field of Classification Search
CPC ..... E05D 2600/626; E05D 2900/531; Y10T 16/54028; Y10T 16/5403; Y10T 16/54038; Y10T 16/54044; B60J 5/047
USPC ..... 16/334, 337, 342, 344; 296/146.11
See application file for complete search history.

(56) References Cited

U.S. PATENT DOCUMENTS

| | | | | |
|---|---|---|---|---|
| 6,739,020 | B1 | 5/2004 | Morawetz | |
| 8,108,969 | B2 * | 2/2012 | Ochiai | E05D 11/1057 16/334 |
| 8,347,460 | B2 * | 1/2013 | Minegishi | E05D 11/1057 16/333 |
| 8,510,914 | B2 * | 8/2013 | Minegishi | E05D 11/1057 16/334 |
| 2006/0112520 | A1 | 6/2006 | Markl et al. | |
| 2007/0050940 | A1 * | 3/2007 | Lowen | E05D 11/1071 16/334 |
| 2012/0246875 | A1 | 10/2012 | Lowen | |

FOREIGN PATENT DOCUMENTS

| | | | |
|---|---|---|---|
| DE | 199 53 077 | A1 | 5/2001 |
| DE | 203 20 183 | U1 | 5/2005 |
| DE | 10 2009 014 084 | B4 | 6/2011 |
| DE | 10 2012 004 810 | A1 | 9/2013 |
| EP | 0 816 610 | B1 | 1/2002 |
| WO | WO 2011/057966 | A1 | 5/2011 |

* cited by examiner

MOTOR VEHICLE HINGE

The invention relates to a motor vehicle hinge.

BACKGROUND

EP 0 816 610 B1 shows a motor vehicle hinge which can be used for the articulated connection of a motor vehicle door to a door frame. The motor vehicle hinge has a first hinge half made of steel which can be fastened to the door frame of the motor vehicle door and which is connected to a second hinge half, which can be fastened to the door, in an articulated manner by a hinge pin. The hinge has a locking device which releasably fixes the two hinge halves at certain pivoting angles in respect of one another, wherein the locking device has an approximately cylindrical sleeve which is attached to the hinge pin in a non-rotatable fashion. The sleeve and a brake member are introduced into hollow spaces recessed out of the solid material of the first hinge half, wherein the brake member sets preferred opening angles for the door using depressions or grooves provided on the circumference of the sleeve. The disadvantage of the known motor vehicle hinge is that in order to achieve given pivoting angles of the motor vehicle door, the sleeve must be large in size, so that the region of the first hinge half in which the sleeve is received has a large radius and is spaced correspondingly far away from the plane in which the hinge half is attached to the motor vehicle door frame. Since the hinge half is a one-piece steel body, numerous machining steps are required in order to create hollow spaces such as channels and openings which allow the integration of the locking device in the hinge half. Although the hinge half is able to withstand the forces and loads introduced by the weight of the door on account of its solid design, this requires it to have a heavy weight. During the machining of the hinge half to create the hollow spaces, a large part of the material is lost in the form of chips and therefore wastage. When the hinge is being assembled, there is a risk that the sleeve will be wrongly attached to the hinge pin, so that the recesses which define the preferred opening angles of the vehicle door are arranged at the wrong points. Finally, the fastening means of the first hinge half are provided substantially outside a plane perpendicular to the bearing plane through the hinge axis, which means that unwanted torques are created by the distance.

DE 199 53 077 A1 describes a motor vehicle hinge for connecting a motor vehicle door to a door frame, having a first and a second hinge half which can each be fastened to the motor vehicle door or to the door frame and are connected to one another in an articulated manner by a hinge pin. A locking device which releasably fixes the two hinge halves in respect of one another continuously in at least certain pivoting angles comprises a non-rotatable sleeve attached to a section of the hinge pin, the circumference of said sleeve being profiled in such a manner that a brake member acted upon by a spring member, which brake member interacts with this sleeve circumference, is deflected to differing degrees, so that a braking torque is produced which counteracts the opening of the door. If the sleeve is rotated along with the hinge pin by pivoting the door, this causes a rotation of the brake member about its axis. The disadvantage of the known vehicle hinge is the fact that the hinge half in which the locking device is arranged is configured as a one-piece solid metal part which is heavy and the hollow spaces for arranging the components of the locking device have to be machined into the tough material thereof. The machining processes involved in this are time-consuming and costly. The large sleeve diameter also makes it necessary for the hinge axis to be spaced relatively far away from the bearing plane of the hinge half on the door frame and also for the region of the hinge half in which the sleeve is received to be correspondingly large in design.

DE 10 2009 014 084 B4 describes a motor vehicle hinge in which a first hinge half is connected to a second hinge half in an articulated manner by a hinge pin, wherein the hinge halves can each be fastened to one of a motor vehicle door and a door frame. A locking device which is arranged in one of the two hinge halves comprises a sleeve arranged on the hinge pin which produces a braking force for the door along with a brake member which can be fed to the sleeve radially. The sleeve rests on the inner circumference of a cylindrical opening with a constant radius. The disadvantage of the known motor vehicle hinge is firstly its heaviness, something to which the hinge half produced from solid material with an integrated locking device contributes, into which complicated hollow spaces must also be introduced, in order to accommodate the locking device. Particularly disadvantageous is the large diameter of the hinge half in the region of the sleeve received therein, which not only produces a large extension of the hinge half but also a radial projection of the hinge half in the region of the sleeve, which is undesirable.

DE 10 2012 004 810 A1 shows a motor vehicle hinge for a side door which exhibits a first hinge half that can be fastened to a door and a second hinge half that can be fastened to a door frame. The two hinge halves are connected in an articulated manner by a hinge pin. Both the first hinge half and also the second hinge half each have a supporting structure made of a carbon-fiber-reinforced plastic and an insert made of plastic which can be inserted or injected into the associated supporting structure in each case in a direction parallel to the hinge axis. The insert has a receiving means for a threaded bushing; the supporting structure has an opening at the point of the receiving means for the threaded bushing. If the insert is introduced into the supporting structure, said insert is fixed in the supporting structure by means of a screw which is tightened into the threaded bushing. By tightening the screw, the first hinge part is simultaneously fastened to the vehicle body. During the injection process, the inserts may be fixed to the supporting structure in each case by means of a protecting rib. The hinge pin has fluting at one end, so that it can be fixed into a receiving means of the first hinge half in respect of rotational movements about its radial axis. The other end of the hinge half is rotatably mounted in the second hinge half. In this case, the hinge pin is only mounted on the insert of the second hinge half, so that the entire vertical force action of the hinge pin is transmitted to the insert; the hinge pin is likewise solely in contact with the insert of the first hinge half, so that a transmission of vertical forces into the supporting structure takes place indirectly at best. The hinge halves of the hinge are produced by first supplying a carbon-fiber-reinforced supporting structure which is then provided with a plastic insert.

SUMMARY OF THE INVENTION

It is an object of the invention to provide a motor vehicle hinge which is improved in terms of size and weight.

According to an aspect of the invention, a motor vehicles hinge is created which comprises a first hinge half that can be fastened to one of a motor vehicle door and a door frame, a second hinge half that can be fastened to the other of the motor vehicle door and the door frame, and a hinge pin which connects the two hinge halves in an articulated manner, wherein at least one of the two hinge halves has a supporting structure and an insert, and that the supporting structure and the insert are fixed in respect of one another. In this way, two properties of the hinge half, namely the possibility of accommodating the locking device and providing a load-receiving means, are separated into two different parts which are fixed in respect of one another and therefore act as one part. In this case, the hinge pin is mounted on at least one eye of the supporting structure. Advantageously but not necessarily, the supporting structure and the insert have a different density, so that a lighter weight part is created overall compared with a solid part.

The motor vehicle hinge preferably comprises a locking device which acts in the insert, so is at least predominantly housed therein. The locking device releasably fixes the two hinge halves in at least certain pivoting angles in respect of one another. This may be an indexing locking device which provides for the preferred holding angles in which a spring member is relatively relaxed, in that a brake member engages therein. This may also be a continuous locking device which, depending on the profiling set, produces different braking torques in the corresponding opening angle. Furthermore, the locking device may also be a device which secures the pivoting movement of the door through a uniform braking torque to prevent it from being caught by gusts of wind. Combinations of the aforementioned designs are also possible.

The housing of the locking device which is extensive in volume terms is substantially caused by the insert, while the bearing of loads, which is substantially characterized by the weight of the door induced into the hinge half and the introduction of the weight of the hinge into the door frame or the motor vehicle door, takes place through the supporting structure. The insert, which only has to bear small loads such as the guiding or bearing of components of the locking device, for example, may come from a lightweight, less expensive material and, in particular, one that can be machined more easily or does not require any machining at all, while the weight and volume of the supporting structure can be designed for the weight to be supported and is not therefore oversized. This produces a substantial weight saving which reduces the weight of the vehicle and its fuel consumption accordingly.

The supporting structure is preferably configured as a metal part, while the insert is formed as a plastics part. Both materials have favorable properties for the specific requirements in terms of formability, producibility and weight, meaning that the resulting motor vehicle hinge is sufficiently stable to bear the loads and, nevertheless, is not oversized. The insert is advantageously fixed to the supporting structure in a form-fitted or frictional manner, for example, but alternatively also by adhesion or by substance-bonded connection. In particular, the hinge half may be produced in that the supporting structure is made from one or a plurality of metal parts which are coated with plastic in an injection mold or from a plastics part, in which the supporting structure is inserted into corresponding guides in one or a plurality of parts.

The supporting structure is preferably formed as an L-shaped or U-shaped bent part made of sheet metal and has a base and at least one, preferably two, legs which are perpendicular to the base. The bent part thereby creates a frame which encloses the insert and can be introduced into the insert. In this case, the at least one leg is preferably pierced by the hinge pin, so that the bearing of the hinge is on the supporting structure and forces and loads can thereby also be introduced at least predominantly into the supporting structure. It is advantageously provided in this case that the base of the bent part is assigned to the door frame or, alternatively, also to the door, and, accordingly, has at least one through-hole for fastening to the corresponding door configuration part, motor vehicle door or motor vehicle door frame. Possible fastening means include threaded bars, rivets, bolts, screws or the like. With regard to subsequent disposal, the insert and bent part are easier to remove than plastic-coated components, making recycling easy following removal.

It is possible for the insert to be produced in several parts, but it is preferable for it to be configured in one piece, which is easily possible with injection molding or molding. If blind holes, undercuts or the like have to be provided in the insert, it may be assembled from two halves divided along a longitudinal axis, for example, which are put together. It is also possible for the hollow spaces, but also the contours, in which the locking device or parts thereof are arranged, to be created from the solid material by machining, for example by milling, although it is simpler for corresponding cores to be provided during injection molding; it is important in this case to ensure that the cores often exhibit a very slight cone shape for easier removal and the corresponding hollow spaces, for example channels or openings, then likewise exhibit a slight cone shape. If the cores are introduced from two sides, this may also involve a double cone, the diameter of which reduces inwardly.

The insert can preferably be introduced into the supporting structure in a direction toward the base of said supporting structure, as a result of which easy assembly is guaranteed. In this case, the supporting structure preferably has an indexing means which penetrates a recess of the insert and clips the insert to the supporting structure. This produces a form-fitted fixing which fixes the insert and the supporting structure in respect of one another for further assembly. It is possible to provide sheet-metal strips which are folded down from the legs of the bent part in the manner of stops, said stops delimiting the insert in a further plane when it is introduced into the supporting structure and thereby fixing the two parts in a further direction in respect of one another. Alternatively, the legs may exhibit stampings which engage in a snapping or clipping manner with corresponding delimiting surfaces of the insert or recesses therefrom. The insert advantageously has a widening at the end facing away from the base which prevents the insert from being inserted in the wrong direction when it is inserted into the supporting structure automatically by robots or the like, for example.

According to an aspect of the invention, a motor vehicle hinge is created, comprising a first hinge half that can be fastened to one of a motor vehicle door and a door frame, a second hinge half that can be fastened to the other of the motor vehicle door and the door frame, a hinge pin that connects the two hinge halves in an articulated manner, and a locking device arranged in one of the two hinge halves, which locking device releasably fixes the two hinge halves in at least certain pivoting angles in respect of one another, wherein the locking device has a locking sleeve assigned to the hinge pin and a brake member interacting with the locking sleeve, wherein the locking device has a locking sleeve assigned to the hinge pin with a radially projecting locking segment and a brake member interacting with a circumferential surface of the locking segment, wherein the brake member is preferably preloaded radially against the outer circumferential surface of the locking segment by a spring member. Through the radially projecting locking segment, a greater outer circumference of the locking segment is advantageously provided which allows a correspondingly improved separation for certain locking positions, without thereby increasing the dimensions of the locking sleeve overall and/or the dimensions of the opening receiving the locking sleeve overall. In the event of an indexing locking characteristic, this may be changed by replacing the locking sleeve, while the hinge otherwise remains unchanged, e.g. for different vehicle models.

The outer circumferential surface may extend over an angle range that corresponds to an opening angle of the motor vehicle door, usually of approx. 75°, of maximum 90°. The outer circumferential surface projects radially in respect of the remaining circumference of locking segment in the manner of an angle segment, as a result of which the delimiting surfaces of the angle segment which connect the outer circumferential surface to the sleeve part of the locking sleeve simultaneously form the stop for maximum and minimum opening angles. The remaining circumference of the locking segment in this case is substantially formed as a cylindrical jacket section which is received in a correspondingly small-sized section of the opening of the hinge half. It is possible for the remaining circumference to act simultaneously as the bearing in this opening, in order to support the pivoting or rotating movement of the angle segment, although it is preferably provided that the entire circumference of the locking sleeve is arranged spaced apart from the opening and therefore the abutting delimiting surfaces of the locking segment at best come to bear against parts of the opening—friction and noise generation, as well as an unwanted change in braking force with changing tribological parameters, are thereby avoided.

By providing the angle segment which has a radius that is at least 20% larger than the remaining circumference of the locking segment, a correspondingly large separation is achieved in the region of the outer circumferential area thereof, wherein the opening for receiving the sleeve with the locking segment may be of smaller dimensions, since the locking segment only crosses an angle which corresponds to twice the opening angle of the vehicle door and is therefore usually less than 180°. In this way, the critical dimension in particular, namely the distance of the bearing plane of the hinge half with the door frame or the motor vehicle door to the averted end, may be smaller. Furthermore, the mass of the sleeve attached to the hinge pin is smaller than a sleeve which completely takes in the radius of the outer circumferential surface of the locking segment. The outer circumferential surface may have recesses or grooves running parallel to the hinge axis which define preferred indexing positions, but it may also have a substantially continuous circumferential profile, in order to achieve continuous locking in a plurality of opening angles of the vehicle door. The fact that the brake member is usually engaged with the outer circumferential surface of the locking segment over the entire course of the opening movement of the door means that a deflection space for the locking segment need only correspond approximately to the angles of the segment. The forward-lying delimitation of the locking segment in the moving direction preferably abuts against a stopping surface of the opening, so that not only is the locking device integrated into the hinge half, but the limit stop too.

It is advantageously provided that the outer circumferential surface of the locking segment exhibits a plurality of holding positions, for example in the form of grooves, and that the holding positions are likewise provided radially further outwards beyond the locking segment in respect of the circumference of the locking sleeve. In this way, it is ensured among other things that the spring acting on the brake member is not completely relaxed when it penetrates a groove in the outer circumference.

It is possible for the stop surface to be lined with metal, in order to prevent wear. The stop surfaces in the region of the opening in which the angle segment is received may be reinforced by folding down a sheet-metal portion from the legs of the bent part, but a metal clip is advantageously used which connects the two stop surfaces across a base that covers the segment. If the insert is produced as an injection-molded part, said metal clip may also be injected into the insert too. The base covers the segment in this case, so that the hinge pin with the sleeve attached can be introduced into the opening of the hinge half from below, without the parts colliding.

The locking sleeve on which the locking segment is arranged is advantageously produced from metal such as steel, so that there is a high wear resistance. Alternatively, however, it may also be a sintered part made of ceramic which can be formed proximate to the end contour.

The locking segment preferably has a central, continuous bore which allows a connection to the hinge pin. For this purpose, the cylindrical inner circumference of the bore is advantageously provided with a knurl which allows the sleeve to be pressed onto a portion of the hinge pin, so that they can be connected to one another in a rotationally fixed manner. Accordingly, when the hinge pin is rotated, the angle segment is turned along the brake member and a corresponding braking force is generated due to the preloading of the brake member.

The insert preferably has an advantageously continuous opening through which the hinge pin passes, which opening allows the locking sleeve with the projecting locking segment to be introduced axially, so that the hinge pin need not have a divided design in the region of the sleeve.

The opening preferably has, in a plane perpendicular to the hinge axis, a first section and a second section, wherein the circumference of the opening in the first section is provided closer to the hinge axis than in the second section. The opening has a first section with a small radius, in which the locking sleeve is enclosed circumferentially, and a second section with a larger radius than in the first section, in which the angle segment is arranged in a pivotable manner over an angle. The first section has a smaller diameter than the second section, wherein the second section substantially faces the attachment plane of the hinge half at the door frame. In this way, the distance between the attachment plane of the hinge half at a door configuration part and the distal end of the hinge half in which the hinge pin runs and which is also referred to as the head roller is reduced and a correspondingly smaller installation space is required.

The second section of the opening is preferably of such dimensions that the locking segment is always engaged with the brake member, irrespective of an opening angle of the two hinge halves, so that a slippage and therefore a disengagement of the two parts of the locking device is prevented. The stage between a first section and second section of the opening may advantageously limit the locking segment in its pivoting angle.

A locating channel is advantageously provided in the insert, in which the brake member is axially displaceable and guided, wherein the locating channel connects the second section of the opening to a front side of the insert facing away from the first section. The axes of the locating channel and of the opening in this case are advantageously arranged perpendicular to one another, in order to allow a radial feed of the brake member. Alternatively, it is also possible, however, for the locating channel to be configured as a blind hole against the closed end whereof the spring member which preloads the brake member rests.

According to a preferred embodiment, it is provided that a support for the end of the spring member facing away from the brake member is adjustable in its axial position in the insert, in order to set the preloading of the spring member and therefore the braking torque achieved between the brake member and outer circumferential surface of the locking segment. The support may be adjusted in a variety of ways, for example by providing intermediate pieces or by a threaded connection, but the support preferably has a prolongation facing away from the spring member which can be adjustably fixed in a through-hole in the supporting structure, in order to set the preloading of the spring. It is possible for the prolongation to be fixed in the adjusted position against the supporting structure, but the prolongation is preferably simultaneously configured as a fastening means for the hinge part to the motor vehicle door or to the door frame, so that the setting of the spring force preloading is fixed with the attachment of the hinge part to the corresponding door configuration part, motor vehicle door or door frame. The fastening to the door configuration part may, for example, involve riveting one end of the prolongation, as a result of which said prolongation is prevented from further rotation and therefore changing the preloading of the spring member. Another possible fastening involves a threaded end of the prolongation being fixed using a nut or a locked nut arrangement.

According to a preferred aspect, part of the locking device is simultaneously a fastening means for the hinge half to the motor vehicle door or door frame. According to another preferred aspect, an axis of a through-hole for a fixing means of the one hinge half spans a plane in space with an axis of the hinge pin.

The provision of a fastening means which runs in the extension of the locating channel or of the brake member and therefore exhibits no lateral offset and therefore no torque in respect of the acting load or else the shortest hinge axis-fastening plane connecting line enables the supporting structure to have a slightly less solid and therefore lighter weight design.

It is furthermore possible for the region in which the prolongation or the fastening means are attached to the supporting structure to be configured with a slightly greater thickness, for example by means of a swaged hole which produces a thickening of the mass of the base of the supporting structure in the region of the through-hole therein, which has a correspondingly more stable design. The swaged hole in this case has a diameter which is smaller than the diameter of the locating channel but is preferably adapted to the diameter of the locating channel, so that when the insert is introduced, there is an additional, form-fitted fixing of the insert to the supporting structure at the same time. The prolongation, which is simultaneously configured as a fastening means and penetrates the base of the supporting structure, moreover fixes the insert to the supporting structure. It is possible, through the adjustability of the support, for raised or lowered braking torques for the hinge to be provided in a particularly advantageous position for dip coating. The hinge in this case may be temporarily fixed to the door frame with the help of the fastening means.

The fastening means preferably penetrates a through-hole in the one hinge half and the through-hole is aligned with a locating channel receiving at least part of the locking device.

When the supporting structure is embodied as a bent sheet-metal part, the eye is preferably provided in the leg of the bent sheet-metal part. The eye is lined with a bushing for this purpose, which ensures the rotatability of the hinge pin in the hinge half. If the bent sheet-metal part has two legs, the hinge pin is advantageously rotatably mounted in an eye of each of the two legs in each case with a corresponding collar bushing. The leg or legs advantageously delimit the opening at the same time, said opening being axially configured in the insert as a continuous opening, so that the receiving means for the locking device is favorably encapsulated to prevent the ingress of contaminants. The hinge pin is advantageously riveted on a side of the leg facing away from the other hinge half, wherein this can take place directly on the collar part of the bushing designed as a collar bushing. In this way, the insert and the supporting structure are advantageously axially clamped, so that the ingress of contaminants at the faces of the legs and of the insert turned towards one another can be effectively avoided. If this seal is not adequate to prevent the ingress of liquids, for example, a sealing strip may be inserted between the aforementioned parts, which strip may, alternatively, also be cured onto one of the surfaces of the supporting structure and insert.

An alternative locking device comprises an indexing ring which is attached to the hinge pin in a non-rotatable manner and turns therewith, and a concentric cam ring which is preloaded by a spring against the indexing ring, which rings exhibit axial surfaces facing one another and produce a braking force when rotated in respect of one another. The spring may be supported indirectly or directly against the insert or door frame.

The vehicle hinge is advantageously designed as a single-pivot hinge in which one hinge half can be fixed to a first door configuration part and the other hinge half to the other door configuration part. For this purpose, a biconical opening may be provided in the other hinge half not fitted with the locking device, into which opening a conical section of the hinge pin can be introduced from one side and a screw bolt exhibiting a conical region from the other side, so that the hinge can be lifted out as a whole. Alternatively, a hexagonal recess is provided in the other hinge half, into which a hexagonal section of the hinge pin with a central threaded bore for receiving a screw bolt can be inserted. The other hinge provided with the double cone or the hexagonal recess may also exhibit a supporting structure and an insert in this case, for example in that the supporting structure provides the two conical surfaces and is otherwise formed as a bent sheet-metal part, while the insert fills the supporting structure and therefore prevents said structure from bending under the load. Under certain circumstances, the same or a comparable insert may even be provided as for the hinge half with the locking device in which, however, no locking device is provided. It is also possible for a locking device to be provided in both hinge halves, for example if greater opening angles than the customary approx. 80° are required or in order to provide a preferred holding position for dip coating with the other locking device, which is no longer required in the subsequent driving operation.

Alternatively, it is also possible for the motor vehicle hinge to be designed as a multiple-pivot hinge, in particular as a four-pivot hinge, in which the actual hinge halves which are fixed to the door configuration parts are connected to one another via two bars. The bar then drives the hinge pin which in the one hinge half can be fixed to the locking device in preferred holding positions. Four-pivot hinges of this kind are used with engine hoods and trunk lids, for example.

According to an aspect of the invention, a method for producing a hinge half and preferably for subsequent connection to a further hinge half for producing a motor vehicle hinge is specified, comprising the steps (S1) arranging a locking sleeve of a locking device in an opening of an insert; (S2) introducing the insert along with the locking sleeve into a supporting structure, as a result of which the locking sleeve can no longer escape from the opening; and (S3) passing a hinge pin through the locking sleeve and the supporting structure.

Prior to the introducing step (S2), the other components of the locking device are preferably also introduced into the insert. The central bore in the locking sleeve, which is spaced apart from the opening in a circumferential manner where necessary, is preferably positioned aligned with eyes in the supporting structure, so that the hinge pin can be introduced in a stroke and riveted to its end. Since the locking sleeve is pressed onto a section of the hinge pin, either a positioning aid through the eye of the supporting structure can keep the locking sleeve centered and act thereupon; preferably, however, an auxiliary mandrel will fix an eye and the central bore of the locking sleeve in respect of one other, the force acting on the locking sleeve to press in the hinge pin is transferred indirectly via the supporting structure onto said locking sleeve and during penetration of the hinge pin, the mandrel is ejected or pulled out.

Further advantages, features, properties and developments of the invention result from the dependent claims and also from the following description of preferred exemplary embodiments.

BRIEF SUMMARY OF THE DRAWINGS

The invention is explained in greater detail below with reference to the attached drawings with the help of preferred exemplary embodiments.

DETAILED DESCRIPTION

Figure 1:
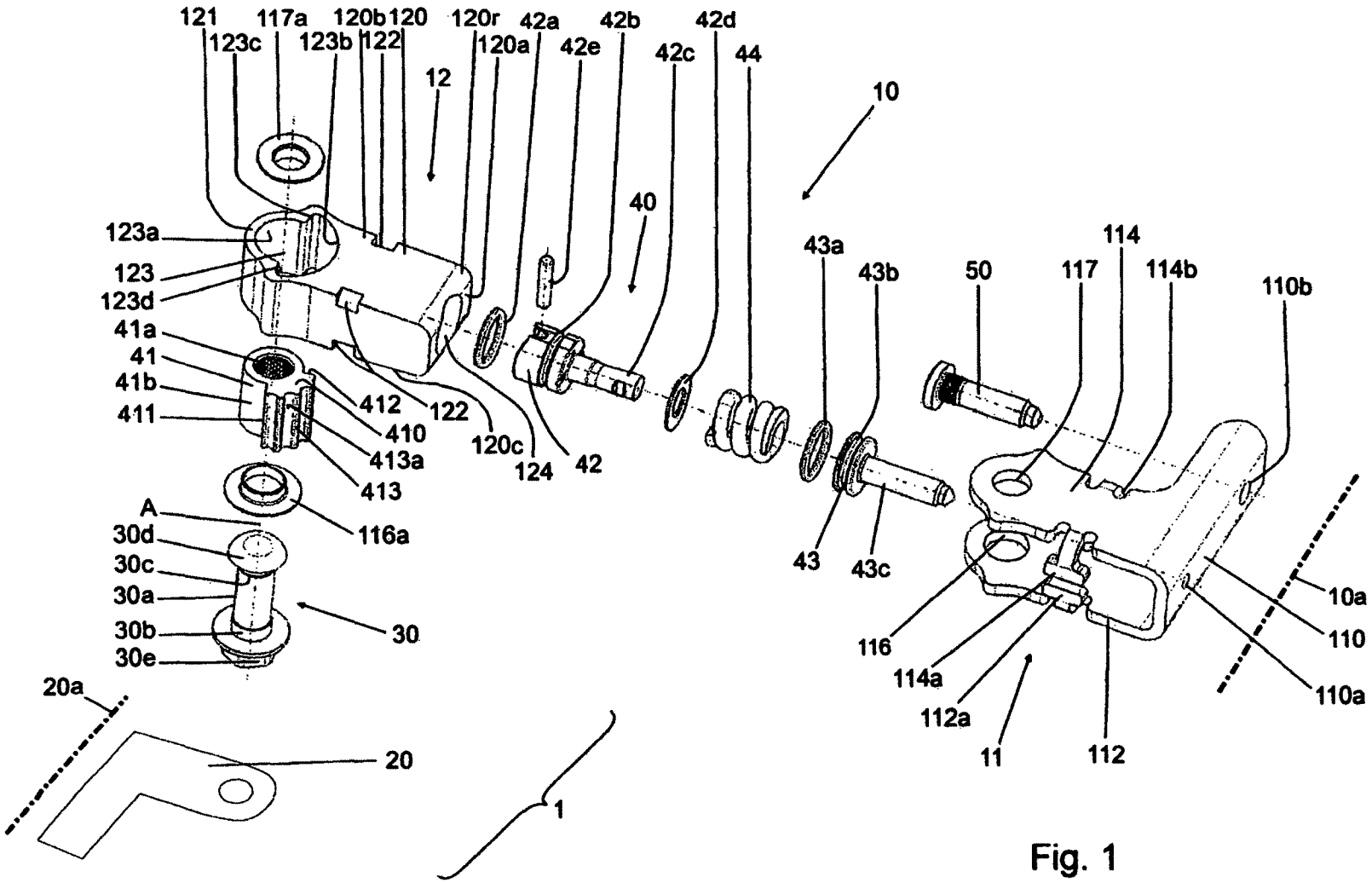
FIG. 1 shows an exploded view of a first hinge half of a preferred exemplary embodiment of a motor vehicle hinge according to the invention.
Figure 7:
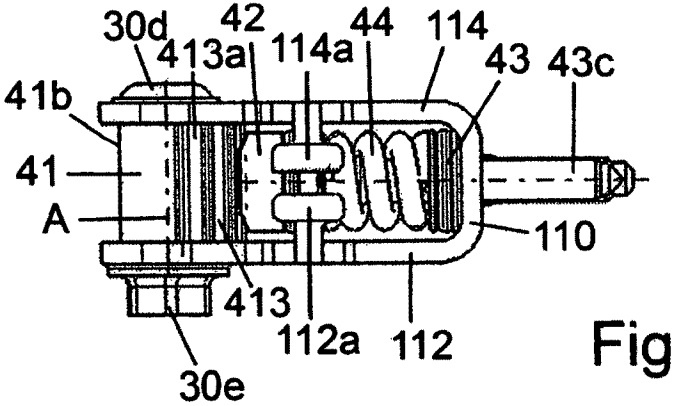
FIG. 7 shows a side view of the hinge half according to FIG. 6.

A hinge 1 is partially depicted in FIGS. 1 to 7 exhibiting a first hinge half 10 and a second hinge half 20 only depicted schematically, wherein the first hinge half 10 can be fastened to a door frame 10*a* indicated by a dotted line and the second hinge half 20 can be fastened to a motor vehicle door 20*a* indicated by a dotted line. The two hinge halves 10, 20 are connected to one another in an articulated manner by a hinge pin 30 which is rotatably mounted in the first hinge half 10 and which is fixed in a torque-proof manner in an opening in the second hinge half 20.

The first hinge half 10 comprises a supporting structure 11 configured as a U-shaped bent sheet-metal part and an insert 12 that can be introduced into the supporting structure 11. The supporting structure 11 comprises a base 110 from which a lower leg 112 and an upper leg 114 project at an angle of approx. 90°. A first through-hole 110*a* is provided in the base 110, which through-hole is covered by the insert 12, and a second through-hole 110*b* is provided which is adjacent to and spaced apart from the insert 12. The side of the base 110 facing away from the insert 12 rests against the bearing edge of the door frame 10*a* in this case and fastening means such as screws, bolts or rivets pass through the through-holes 110*a*, 110*b*, something that will be explained in greater detail below. The supporting structure 11 is of angular configuration overall, wherein the one leg of the angle is folded in a U-shape and points in the extension direction of the base 110 and the other leg of the angle is formed by the two legs 112, 114, cf. also in particular FIG. 3.

Figure 2:
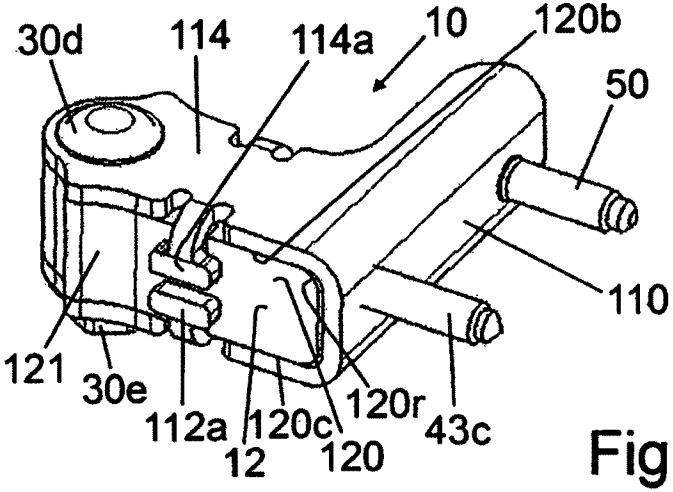
FIG. 2 shows a perspective view of the hinge half according to FIG. 1.
Figure 4:
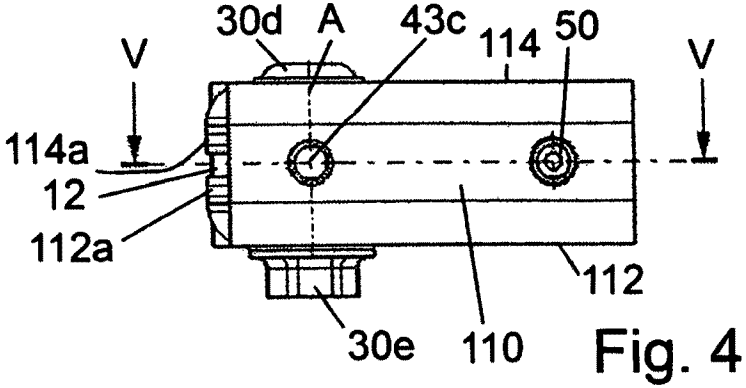
FIG. 4 shows a view from the direction of a fastening plane of the hinge half according to FIGS. 1 to 3.
Figure 3:
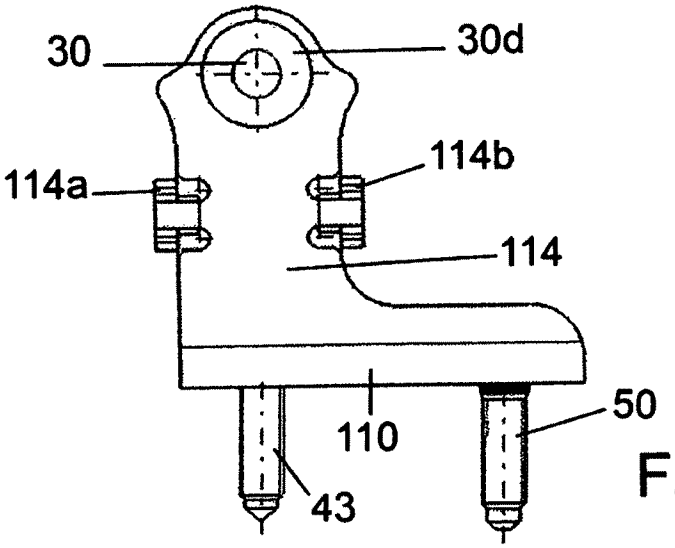
FIG. 3 shows a view from above of the hinge half according to FIGS. 1 and 2.
Figure 6:
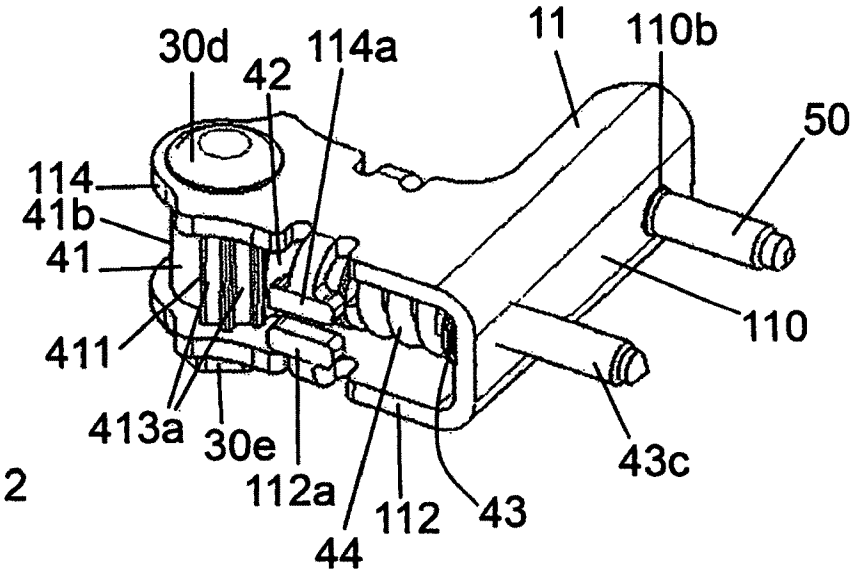
FIG. 6 shows a perspective view of the hinge half according to FIGS. 1 to 5 with the insert left out.

On either side of the legs 112, 114 there is a stop 112*a*, 114*a*, 112*b*, 114*b* angled at 90° and closing a plane perpendicular to the legs 112, 114 and perpendicular to the base 110 angled at 90° in each case, said stops, when taken in pairs, creating a lateral delimitation for the insert 12, the stops 112*a*, 114*a* on one side of the insert 12 and the stops 112*b*, 114*b* on the other side of the stop, cf. in particular also FIG. 2. Between each stop 112*a*, 112*b*, 114*a*, 114*b* and the flat extension of the legs 112, 114 are four bent metal sections which connect the stops 112*a*, 112*b*, 114*a*, 114*b* to the legs 112, 114, which project inwards opposite an exact right angle and thereby form indexing means which can move into corresponding recesses 122 in the insert 12 which will be explained later.

The insert 12 is produced as a one-piece part from an either transparent or opaque plastic by injection molding and has a box-shaped section 120 which is turned towards the base 110 and a projecting section 121 which is turned away from the base 110, which are configured as a one-piece injection-molded part. A front side 120*a* of the box-shaped section 120 turned away from the projecting section 121 has a rounded transition 120*r* to the parallel upper and lower delimiting surfaces 120*b*, 120*c* of the box-shaped section 120 and of the projecting section 121 of the insert 12 which is adapted to the radius between the base 110 and the legs 112, 114. The lateral delimiting surfaces 120*d*, 120*e* of the box-shaped section 120 are spaced apart in such a manner that they can be introduced between the stops 112*a*, 114*a*, on the one side, and 112*b*, 114*b*, on the other side, wherein recesses 122 are made in the insert 12 at the height of the stops with metal sections connecting the legs 112, 114, which recesses allow the connections to snap in and therefore facilitate a form-fitted fixing of the insert 12 in the supporting structure 11.

Figure 5:
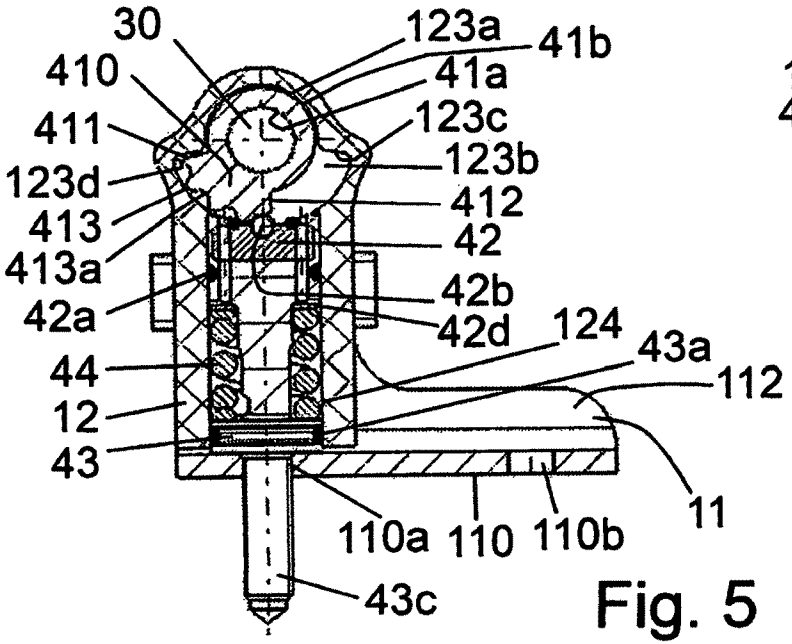
FIG. 5 shows a cross section through the hinge half according to FIG. 4 along the line V-V.

The projecting section 121 of the insert 12 has an opening 123 passing through the wide delimiting surfaces 120*b*, 120*c* which exhibits a first section 123*a* which has a radius about the hinge axis A depicted as a dotted line and a second section 123*b* with a radius which is approx. 40-60% larger than that of the first section 123*a*, wherein the first section represents an opening angle of slightly more than 180° and the second section 123*b* of slightly less than 180°, as can be seen from the sectional depiction in FIG. 5. A cylindrical locating channel 124 connects the front side 120*a* and the second section 123*b* of the opening 123, wherein the locating channel 124 has a diameter representing more than half the distance of the wide delimiting surfaces 120*b*, 120*c*.

A locking arrangement 40 is housed entirely or at least predominantly in the insert 12. The locking arrangement 40 comprises a locking sleeve 41 with a central bore 41*a* and a locking segment 410 which projects in the manner of an angular segment radially over the remaining circumference 41*b* of the locking sleeve 41. The locking sleeve 41 is produced from steel and has a knurl in the region of its central bore 41*a*, which knurl allows pressing onto a section 30*a* of the hinge pin 30. In this case, the outer circumferential surface 41*b* in the first section 123*a* is received with a radial gap, while the locking segment 410 is received in the second section 123*b* with a radial gap.

The two legs 411, 412 of the locking segment 410 limit the pivotability of the locking sleeve 41 in the opening 123 when said legs abut against the planes or steps 123*c*, 123*d* roughly directed at the hinge axis at the transition of the greater section 123*b* to the smaller section 123*a*. Four vertical grooves 413*a* are made facing away from the axis A in the circumferential surface 413 pointing outwardly radially from the axis A, which grooves allow a preferred indexing position of the brake member 42 of the locking device 40 and thereby set preferred opening angles of the vehicle door 20*a* attached to the hinge 1.

The locking configuration 40 further comprises a brake member 42 which is preloaded by a spring member 44 supported against a support 43 in the direction of the opening 123 in the locating channel 124, which parts 43, 44 are likewise housed in the locating channel of the insert 12. For sealing purposes, on the brake member 42 or on the support 43 in each case, O-rings 42*a* and 43*a* made of plastic are arranged radially in each case in corresponding grooves 42*b* in the brake member 42 or 43*b* of the support 43. The brake member 42 has a centering pin 42*c* turned away from the opening 123 which passes through a flat washer 42*d* and penetrates the central hollow space of the spring member 44 configured as a helical spring. The spring member 44 rests against a front plate of the support 43 and tensions the brake member 42 in the direction of the opening 123 within the locating channel 124. In a front side of the brake member 42 facing the opening 123, a roller 42*e* made of steel is inserted in a corresponding groove in the front side facing the opening 123, which roller is adjusted to the width of the groove 413*a* of the locking segment 410 configured as an indexing segment and interacts therewith and defines a preferred opening position of the hinge 1. In order to achieve an improved adjustment to the outer contour of the indexing segment 410, the front side of the brake member 42 facing the locking segment 410 is folded in a V-shape along the vertically running groove to receive the indexing roller 42*e*, with the groove as the deepest line, as is shown most clearly in FIG. 1. The brake member 42, the spring 44 and the support 43 are each formed from steel.

Bores 116, 117 which are aligned with one another are provided in the legs 112, 114, wherein the bore 116 in the leg 112 exhibits a slightly larger diameter than the bore 117 in the upper leg 114. The bores 116, 117 are each lined with a collar bushing 116*a*, 117*a*, wherein the collars are each arranged on the side of the leg 112, 114 projecting from the other leg. The inner diameters of the collar bushings 116*a*, 117*a* are adapted to sections 30*b*, 30*c* of the hinge pin 30 and allow a rotation of the hinge pin 30 about the axis A. It can be seen in FIG. 1 that the hinge pin 30 has a collar adjacent to the section 30*b*, which collar is then turned towards the outwardly facing side of the leg 112, wherein the collar of the collar bushing 116*a* facilitates or allows the pivoting of the two surfaces in respect of one another.

On the side of the support 43 facing away from the brake member 42, said support has a prolongation 43*c* which exhibits an external thread at least in sections and which can be guided through the bore 110*a*. In this case, the prolongation 43*c* largely projects beyond the bearing plane of the base 110 with the door configuration part 10*a* and is therefore simultaneously a connection means with the door frame 10*a*. Along the threaded section, the prolongation 43*c* may be locked in the bore 110*a*, in order to adjust the preloading force of the spring member 44 on the brake member 42. A further fastening means 50 passes through the other bore 110*b*. The ends of the fastening means 43*c*, 50 each have a rivet head which can be fixed by riveting to the door frame 10*a* on the side thereof facing away from the hinge half 10, as a result of which the adjustment of the support 43 is also fixed. It can be seen that the support 43 which penetrates the locating channel 124 of the insert 12 and is fixed to the base 110 via the prolongation 43*c* likewise fixes the insert 12 and the supporting structure 11 with one another, cf. also FIGS. 5 and 7. It can be seen from FIG. 4, for example, that the fastening means created by the extension 43*c* stands perpendicularly on the hinge axis A, so that there is no lateral displacement between the perpendicular plane of the hinge axis on the base and the perpendicular plane of the fastening means 43*c* on the base.

The hinge half 10 is assembled as follows:

The locking sleeve 41 is initially arranged in the bore 123, in addition the brake member 42 in the locating channel 124 along with the spring 44 and the support 43. Alternatively, the support 43 is fixed to the base 110 via the prolongation 43*c* in such a manner that it only projects slightly beyond the inside of the base 110. The collar bushes 116*a*, 117*b* are inserted into the eyes 116, 117. The insert 12 fitted with the corresponding parts is therefore introduced into the receiving space of the supporting structure 11 delimited by the legs and the base, wherein in the end phase of the introductory movement the threaded section of the support 43 is tightly screwed in the through-hole 110*a* and/or the support 43 comes to bear against the spring member 44 and causes a preloading of the brake member 42 in the direction of the outer circumferential area 413 of the locking segment 410 of the locking sleeve 41—hence the metal sections engage with the recesses 122 of the insert 12 and fix the insert 12 in a form-fitted manner on the supporting structure 11, from which the insert 12 can no longer simply slide out.

The hinge pin 30 is then guided from below through the eye 116 fitted with the collar bushing 116*a*, the bore 41*a* of the locking sleeve 41 and the eye 117 fitted with the collar bushing 117*a* and the projecting riveting section 30*d* is riveted on the collar bushing 117*a*. For this purpose, the locking sleeve 41 can be aligned with the eyes 116, 117 using auxiliary means and held in an angular position relative to the hexagon head 30*a*.

Using a tool which grips a hexagon head 30*e* of the hinge pin 30, the hinge pin 30 with the sleeve 41 attached thereto is brought into an angular position which corresponds to the opening angle in which the second hinge half 20 is placed on the hexagon head 30*e*. Consequently, the hinge pin 30 is turned by the pivoting movement of the second hinge half 20 about the hinge axis A.

The hinge 1 then functions at a reduced weight and size like a hinge known in the art with an integrated door locking function.

The invention has been explained above with the help of an exemplary embodiment which is configured as a door hinge capable of being unhinged for a side motor vehicle door. It has to be understood that other motor vehicle doors or lids can also be fitted in a comparable way with a corresponding locking device.

The invention has been explained above with the help of an exemplary embodiment in which there is indexing locking of the vehicle door; it has to be understood that non-indexing, continuous locking of the vehicle door can also be achieved with a correspondingly designed locking sleeve.

The invention has been explained above with the help of an exemplary embodiment in which locking is achieved by a radial feed of the brake member to the locking sleeve. It has to be understood that an axial feed of a correspondingly designed brake member towards a correspondingly formed front side of the locking sleeve is also possible.

The invention has been explained above with the help of an exemplary embodiment in which the hinge part 10 is attached with the locking device 40 to the door frame 10*a*; it has to be understood that the hinge part can also be attached with the locking device to the door.

The invention has been explained above with the help of an exemplary embodiment in which the hinge part 10 has a U-shaped supporting structure 11 with two legs 112, 114. It has to be understood that an L-shaped supporting structure with only one leg 112 is also possible, if the opening 123 is not continuous, for example, or a cover which limits the front side of the opening turned away from the leg 112.

What is claimed is:

1. A motor vehicle hinge comprising a first hinge half that can be fastened to one of a motor vehicle door and a door frame;

a second hinge half that can be fastened to the other of the motor vehicle door and the door frame; and a hinge pin which connects the two hinge halves in an articulated manner, at least one of the two hinge halves having a supporting structure and an insert, the supporting structure and the insert being fixed in respect of one another, and the hinge pin being mounted on at least one eye of the supporting structure, wherein the supporting structure is formed as one of an L-shaped and an U-shaped bent part made of sheet metal and has a base and at least one leg which is perpendicular to the base, the at least one leg being pierced by the hinge pin, the base having at least one through-hole for fastening to the motor vehicle door or door frame, the insert being configured as one piece, wherein the insert is introducible into the supporting structure in a direction toward the base of said supporting structure, the supporting structure having an indexing means which penetrates a recess of the insert and clips the insert to the supporting structure.

2. The motor vehicle hinge as recited in claim 1 wherein the insert is formed as a plastics part, the insert being fixed to the supporting structure.

3. A motor vehicle hinge comprising a first hinge half that can be fastened to one of a motor vehicle door and a door frame;

a second hinge half that can be fastened to the other of the motor vehicle door and the door frame; and a hinge pin which connects the two hinge halves in an articulated manner, at least one of the two hinge halves having a supporting structure and an insert, the supporting structure and the insert being fixed in respect of one another, and the hinge pin being mounted on at least one eye of the supporting structure, wherein the eye is lined with a bushing, the supporting structure axially delimiting a continuous opening provided in the insert.

4. The motor vehicle hinge as recited in claim 3 wherein the at least one of the two hinge halves comprises a locking device which releasably fixes the two hinge halves in at least certain pivoting angles in respect of one another, the locking device acting in the insert.

5. The motor vehicle hinge as recited in claim 4 wherein the locking device has a locking sleeve assigned to the hinge pin, wherein the locking sleeve has a locking segment projecting radially in respect of the remaining circumference of the locking sleeve in the manner of an angular segment, wherein the locking device has a brake member interacting with the locking segment, wherein the brake member is preloaded radially against an outer circumferential surface of the locking segment by a spring member, wherein the outer circumferential surface extends over an angle range which corresponds to an opening angle of the motor vehicle door.

6. The motor vehicle hinge as recited in claim 5 wherein the locking sleeve has a central bore which allows an attachment to the hinge pin, when the hinge pin turns, the locking segment is rotated along the brake member, the insert including the continuous opening through which the hinge pin passes at least partially, having a first section with a small radius in which the locking sleeve is enclosed circumferentially, and a second section with a larger radius, in which the locking segment can be pivoted over an angle, the insert having a locating channel in which the brake member is axially guided, the locating channel connecting the second section of the opening to a front side of the insert facing away from the first section of the opening.

7. The motor vehicle hinge as recited in claim 5 wherein a support for the end of the spring member facing away from the brake member is adjustable in an axial position thereof in the insert and is fixable via a prolongation facing away from the spring member to a through-hole of the supporting structure, the prolongation being as well a fastening means for the hinge half to the motor vehicle door or door frame.

8. The motor vehicle hinge as recited in claim 3 wherein the supporting structure is formed as one of an L-shaped and an U-shaped bent part made of sheet metal and has a base and at least one leg which is perpendicular to the base, the at least one leg being pierced by the hinge pin, the base having at least one through-hole for fastening to the motor vehicle door or door frame, the insert being configured as one piece.

9. The motor vehicle hinge as recited in claim 3 wherein the motor vehicle hinge is designed as a single-pivot hinge.

10. A motor vehicle hinge, comprising a first hinge half fastenable to one of a motor vehicle door and a door frame;

a second hinge half fastenable to the other of the motor vehicle door and the door frame;

a hinge pin which connects the two hinge halves in an articulated manner; and a locking device arranged in one of the two hinge halves, the locking device releasably fixing the two hinge halves in at least certain pivoting angles in respect of one another, the locking device having a locking sleeve assigned to the hinge pin and a brake member interacting with the locking sleeve, the locking sleeve having a locking segment which projects in the manner of an angular segment radially over the remaining circumference of the locking sleeve, and the brake member being preloaded radially against the outer circumferential surface of said locking segment, wherein the outer circumferential surface of the locking segment exhibits a plurality of holding positions, the holding positions being likewise provided radially further outwards beyond the locking segment in respect of the circumference of the locking sleeve.

11. The motor vehicle hinge as recited in claim 10 wherein the brake member is preloaded radially against an outer circumferential surface of the locking segment by a spring member, the outer circumferential surface extending over an angle range which corresponds to an opening angle of the motor vehicle door.

12. The motor vehicle hinge as recited in claim 10 wherein hollow spaces for at least partially receiving the locking device are received in a plastics insert of the first hinge part.

13. The motor vehicle hinge as recited in claim 10 wherein grooves are formed in the outer circumferential surface of the locking segment which a roller of the brake member can penetrate, in order to define preferred holding positions of the hinge.

14. The motor vehicle hinge as recited in claim 10 wherein a part of the locking device is simultaneously a fastening means for the hinge half to one of the motor vehicle door and the door frame.

15. The motor vehicle hinge as recited in claim 14 wherein the fastening means passes through a through-hole in the one hinge half, the through-hole being aligned with a locating channel receiving at least part of the locking device.

16. The motor vehicle hinge as recited in claim 14 wherein the part of the locking device forming a fastening means is a support for a spring member of the locking device acting on the brake member, and where the support is adjustable relative to a through-hole in the one hinge half.

17. The motor vehicle hinge as recited in claim 14 wherein an axis of the hinge pin and an axis of the through-hole receiving the fastening means span a plane.

18. The motor vehicle hinge as recited in claim 17 wherein the locking sleeve is arranged in an opening of the one hinge half, there being at least one position of the locking sleeve in which the radial circumference of the locking sleeve exhibits a gap relative to the opening.

19. A motor vehicle hinge, comprising a first hinge half fastenable to one of a motor vehicle door and a door frame;

a second hinge half fastenable to the other of the motor vehicle door and the door frame;

a hinge pin which connects the two hinge halves in an articulated manner; and a locking device arranged in one of the two hinge halves, the locking device releasably fixing the two hinge halves in at least certain pivoting angles in respect of one another, the locking device having a locking sleeve assigned to the hinge pin and a brake member interacting with the locking sleeve, the locking sleeve having a locking segment which projects in the manner of an angular segment radially over the remaining circumference of the locking sleeve, and the brake member being preloaded radially against the outer circumferential surface of said locking segment, wherein the hinge half in which the locking device is arranged has an opening which has a first section with a small radius, in which the locking sleeve is surrounded circumferentially by the hinge half, and which has a second section with a larger radius, in which the locking segment is arranged in a pivotable manner over an angle.

20. The motor vehicle hinge as recited in claim 19 wherein the hinge half has a locating channel in which the brake member is axially guided, the locating channel opening out in the second section of the opening.

21. The motor vehicle hinge as recited in claim 19 wherein the second section of the opening is of such dimensions that the locking segment is always engaged with the brake member, irrespective of an opening angle of the two hinge halves.

22. The motor vehicle hinge as recited in claim 19 wherein the opening is at least partially closed at least at one end by a part of the hinge half.

23. The motor vehicle hinge as recited in claim 19 wherein the locking sleeve has a central bore which allows an attachment to the hinge pin, when the hinge pin turns, the locking segment being rotated along the brake member, the locking segment having side legs at an acute angle, which legs can abut against limits of the opening.

24. The motor vehicle hinge as recited in claim 19 wherein an axis of a through-hole for a fastening means of the one hinge half spans a plane in space with an axis of the hinge pin.

25. The motor vehicle hinge as recited in claim 19 wherein the circumference of the opening in the first section is provided closer to the hinge axis than in the second section.

* * * * *